United States Patent [19]

Koiso

[11] 4,425,299

[45] Jan. 10, 1984

[54] METHOD FOR BONDING SINTERED METAL PIECES

[75] Inventor: Takashi Koiso, Osaka, Japan

[73] Assignee: Sumitomo Electric Industries, Ltd., Osaka, Japan

[21] Appl. No.: 302,355

[22] Filed: Sep. 15, 1981

[30] Foreign Application Priority Data

Sep. 24, 1980 [JP] Japan ..... 55-133223
Nov. 25, 1980 [JP] Japan ..... 55-166453

[51] Int. Cl.[3] ..... B22F 7/02
[52] U.S. Cl. ..... 419/6; 228/165
[58] Field of Search ..... 75/208 R; 228/165; 419/6, 7

[56] References Cited

U.S. PATENT DOCUMENTS 1,446,274 2/1923 Roberts ..... 228/165
4,146,165 3/1979 Lesgourgues ..... 228/165

*Primary Examiner*—Brooks H. Hunt
*Assistant Examiner*—Anne Brookes
*Attorney, Agent, or Firm*—Wenderoth, Lind & Ponack

[57] ABSTRACT

The invention relates to a method for bonding pieces of iron group sintered metals, and more particularly to a method for producing a sintered part having a complicated configuration by bonding more than 2 iron group sintered metal pieces to each other at the flat faces thereof according to this method, through holes are provided in predetermined locations of each of the metal pieces except the one constituting the lowermost layer, and if necessary, a concave groove having a depth of 0.03–1 mm is provided on the metal face to be bonded in each layer. The metal pieces are then superposed with said through holes coinciding with each other, with a brazing alloy being inserted into each of the through holes; heating the whole assembly so as to help said brazing alloy infiltrate into each of the interfaces, thereby bonding more than 2 pieces of iron group sintered metals to each other at a low cost.

4 Claims, 12 Drawing Figures

METHOD FOR BONDING SINTERED METAL PIECES

The invention relates to a method for bonding iron group sintered metal pieces, and more particularly to a method for producing a sintered part of a complicated configuration by bonding more than 2 pieces of iron group sintered metal produced by powder metallurgy at the flat faces of said pieces. The invention is characterized in that a through hole is provided at a predeterminedlocation of each metal piece, except the one constituting the lowermost layer, and in addition, if necessary, a concave groove 0.03–1 mm in depths is provided on the face to be bonded of each of the metal pieces, said metal pieces being superposed with said through holes coinciding with each other so as to facilitate the infiltration of the brazing alloy. The whole assembly is then heated to braze the alloy inserted into the through hole to permit it to infiltrate into each of the faces of the metal pieces to be bonded to each other.

In recent years, iron group sintered metal parts have been put into practical use in motorcars, household electric appliances, office machines, etc. with the scope of application expanding steadily. Such metal parts are now supplied in a wide variety of configurations, and there is a demand for a still higher quality.

U.S. Pat. No. 2,652,520, U.S. Pat. No. 2,913,819, BP No. 628,679, DP No. 749345, etc. disclose conventional powder pressing method according to ordinary powder metallurgy techniques. These methods, however, are no longer suitable for the bonding of iron group sintered metal pieces. Even when a metal mold of complicated configuration is devised and produced, it will involve many difficulties, for example, high production cost, lack of strength due to density distribution, etc.

In view of the aforedescribed conventional difficulties, the applicant has invented a method for bonding two sintered compacts to each other, wherein more than one recess is formed on at least one of the combination comprising more than two pieces of iron group sintered metals, said recess being filled with a brazing alloy. The whole assembly is then heated so as to facilitate the infiltration of the brazing alloy into the interfaces to be bonded together, thereby enabling one to bond at least 2 sintered compacts to each other.

When the area to be bonded is large, it is necessary that the amount of the brazing alloy be increased. According to the abovedescribed method, however, the recess containing the brazing alloy can not be enlarged under the restriction of the configuration of the product. Thus satisfactory bonding is unobtainable in some cases.

In order to overcome this difficulty, the applicant has invented another method wherein, when the bonding area is large, a third iron group sintered metal is inserted into one of the two kinds of iron group sintered metals to be bonded together, wherein a brazing alloy is placed thereon, with the whole assembly being heated above the melting point to bond the two faces together.

This method, however, has a disadvantage in that it involves a high cost, since the extra cost of material and processing is inevitable due to the use of a third iron group sintered metal. In addition, insertion of the third iron group metal is impossible in some cases due to the configuration of the assembly.

It is an object of the present invention to provide a method for perfectly bonding more than two faces of iron group sintered metals without using a third iron group sintered metal therebetween, even when the bonding areas are large. The invention has for another object to provide a method for producing economically, and in large amounts such parts having very complicated configurations as are not producible by a single operation with a metal mold, for example, a part having a hollow portion or parts having steps on the outside and constricted in the middle of the body thereof, etc.

The invention will hereinunder be described in detail in reference to the accompanying drawings.

FIGS. 3(A)–(E) are perspective views showing the bonding process.

FIGS. 4(A)–(E) shows alternate embodiments of the invention, wherein (A) is a plan view, (B) is a longitudinal sectional view, (C) is a bottom view, (D) is a sectional view taken along the line D—D of (B), (E) is a sectional view taken along the line E—E of (D).

Figure 1:
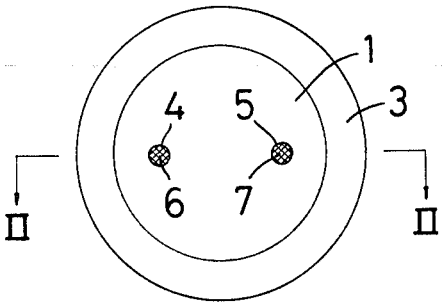
FIG. 1 is a plan view showing an embodiment of the invention.
Figure 2:
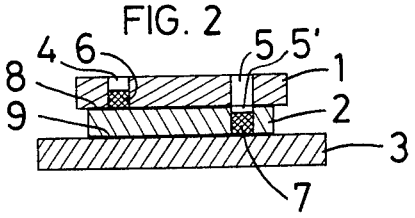
FIG. 2 is a sectional view taken along the line II—II of FIG. 1 and shows 3 iron group metal pieces before they are superposed and subjected to sintering (stage).

In FIG. 2 the metal piece 1 of the uppermost layer is formed with through holes 4 and 5, with no through holes being provided on the metal piece 3 constituting the lowermost layer. Brazing alloy 6 and 7 are inserted into the through holes 4 and 5. The metal pieces 1, 2 and 3 are superposed so that the through holes 5 and 5' will coincide with each other. When the whole is heated at a temperature at which the brazing alloy melts, the melted brazing alloy 6 infiltrates into the interface 8 between the metal pieces 1 and 2 while the brazing alloy 7 fully infiltrates into the interface 9 between the metal pieces 2 and 3, thereby permitting one to produce a part of a complicated configuration having steps on its outside in which the metal pieces 1, 2 and 3 have been perfectly and integrally bonded together.

The brazing alloy may be an alloy piece or a tablet obtained by pressing a powdered brazing alloy.

The metal piece may be a pressed compact obtained by pressing a iron group metal powder or a sintered compact thereof. In the case of a pressed compact, sintering and bonding may be effected synchronously.

Although an example of 3 metal pieces has been described above, it is to be understood, however, that bonding is similarly feasible in the case of combining more than 3 metal pieces.

The through holes can be formed in a predetermined position with precision be pressing a metal piece with a preliminarily prepared metal mold. For the accurate superposition of the metal pieces, such notch or the like is provided so as not to impair the properties of the finished product by pressing the process in a suitable location. Such notch is helpful to hold the metal pieces in place during the sintering (stage).

Bonding of 2 iron group sintered metal pieces at the interface thereof will now be described below in detail in reference to FIG. 4.

Figure 4:
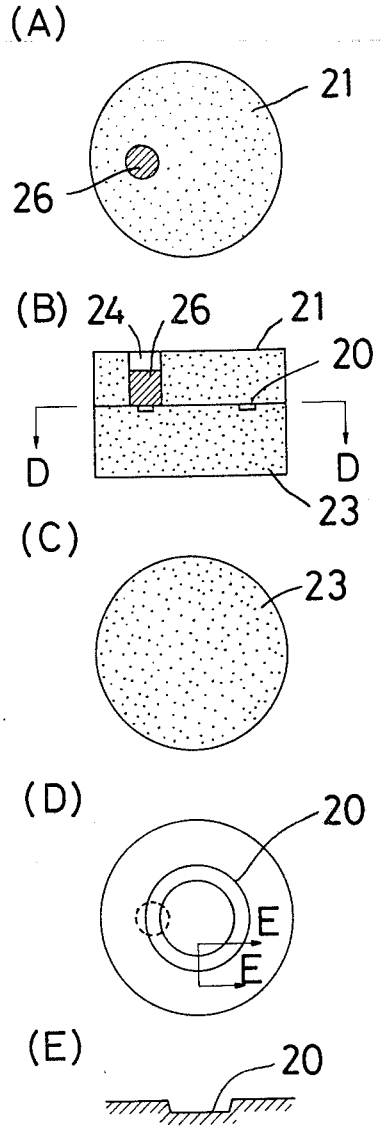

According to FIG. 4-(B), the weight of the brazing alloy can be varied by providing a through hole 24 for receiving the brazing alloy 26 on at least one of the iron group sintered metal pieces 21 and 23 to be bonded together at the interface thereof. By providing such through holes in multiplicity, the length of penetration of the molten alloy can be shortened, thereby making it possible to produce a satisfactorily bonded interface. In many cases, however, it is impossible to form a multiplicity of through holes due to the particular make up of the configuration. Thus, the time of penetration of the molten alloy is lengthened. Particularly when the interface is smooth, satisfactory bonding cannot be obtained, since the two faces are brought into closer contact with each other.

When the brazing alloy is heated above its melting point, it infiltrates into the interface by capillary force. The applicant, therefore, attempted to obtain satisfactorily bonded interface by controlling the space between the two faces so as to permit the capillary action to work effectively.

A uniform space and a satisfactorily bonded interface can be provided by forming a concave groove 20 on at least one of the two faces to be bonded together as shown in FIG. 4(B). Since the iron group sintered metal is pressed by a metal mold, the concave groove 20 can be formed in any optional size and configuration. Moreover, the depth of the groove has high precision thereby providing a highly uniform space between the two faces to be bonded together. The depth of the groove is preferably 0.03–1 mm.

FIG. 4(B), FIG. 4(D) and FIG. 4(E) each show an example in which a concave groove 20 is formed on at least one of the two faces of the iron group sintered metal pieces. It is needless to say that the provision of a concave groove is not limited to the bonding between the two faces, but to bonding of more than two faces. The concave groove can be replaced by a projection with the same effect.

The invention will now be described in more detail in reference to the following examples.

EXAMPLE 1

Figure 3:
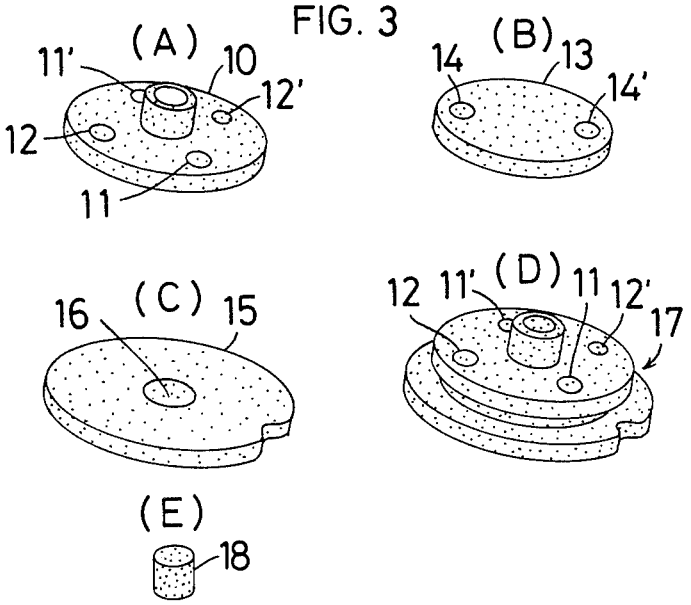

Pressed compacts 10, 13 and 15 in the shape of (A),(B),(C) of FIG. 3 were produced from a powder mixture of iron group sintered metals composing 2 weight % Cu and 0.8 weight % C with the residual part consisting of Fe. The green density was 6.5 g/cm$^3$ for (A), and 6.8 g/cm$^3$ for (B) and (C).

Through holes 11 and 11', 12 and 12', 14 and 14' for receiving brazing alloys were formed on the pressed compacts 10 and 13 at the time of pressing. Said pressed compacts were superposed as shown in FIG. 3 (D), and a pressed compact 18 of the brazing alloy as shown in FIG. 3(E) composing 40% Ni and 40% Cu with the residual part consisting of Mn was inserted into each of the through holes 11,11', 12 and 12' of the uppermost layer. The whole was sintered in an atmosphere of an endothermic gas (derived from butane) at 1150° C. for 1 hour. The sintered part, thus-obtained, was an integrated part as shown by the perspective view of FIG. 3(D). The brazing alloy had fully infiltrated into each of the interfaces thereby rigidly bonding the pressed compacts 10, 13 and 15 to each other.

In this example, the pressed compacts, FIGS. 3(A), 3(B) and 3(C), were combined as shown in FIG. 3(D) before sintering. Alternatively, however, the pressed compacts FIGS. 3(A), 3(B) and 3(C) may be preliminarily sintered before they are combined and heated. In this case, the temperature can be lower and heating time can be reduced to 15 minutes.

EXAMPLE 2

There was produced a pressed compact comprising an iron group sintered metal designated at 21 in FIG. 4(B), of a composition of Fe-2%Cu-0.8%C, with a green density 6.5 g/cm$^3$, and another iron group sintered metal, designated at 23 in FIG. 4(B), of the composition of Fe-2%Cu-0.8%C, with a green density of 6.5 g/cm$^3$. A pressed compact of a brazing alloy 26 of the composition of Mn-40%N-40%Cu was placed in a through hole 24 provided on the sintered metal 21 in FIG. 4(B). The two pressed compacts of sintered metal 21 and 23 were combined face to face each other. They were bonded to each other by sintering them in an atmosphere of an endothermic gas (derived from butane) at a temperature of 1150° C.

When the interface was smooth, defective compacts were produced up to 50%. However, when a concave groove 20, of 0.1 mm in depth and 1 mm in width, was provided on the sintered metal 23, the bonded compacts were 100% satisfactorily. It was found that the provision of a concave groove on at least one of the faces to be bonded was highly effective.

The amount of the molten alloy having a composition of Mn-40%Ni-40%Cu varies in accordance with the sintering temperature. Even when a brazing alloy of the same weight is used, the molten alloy fails to reach the outer periphery or overflows it. Even when the sintering temperature is fixed, the temperature distribution in the sintering furnace makes it very difficult to hold the temperature uniform. In this connection, it was found that satisfactory bonding can be accomplished by imparting the concave groove with a depth of 0.6–1 mm.

EXAMPLE 3

Iron group sintered metal pieces 21 and 23 of a composition of Fe-2% Cu-0.8% C and a green density of 6.6 g/cm$^3$; the same as in Example 1 were used. A pressed compact of a brazing alloy 26 composing Mn-40%Ni-40%Cu was placed in a through hole 24 providedon one of the sintered metal 21 in FIG. 4(B). On the other pressed compact of sintered metal 23 there was preliminarily formed a concave groove 20 of 1 mm in depth as shown in FIG. 4(D) and FIG. 4(E). The two pressed compacts were combined face to face and bonded to each other by sintering them in an atmosphere of an endothermic gas (derived from butane) at 1150° C. for 30 minutes.

As a result, the ratio of defective products was reduced to 2% from 25% when a concave groove 20 is provided therein. This shows that the molten alloy in a suitable amount has infiltrated into the interface without overflowing the outer periphery with its excess being collected in the recess.

When the concave groove 5 provided on one of the pressed compacts of iron group sintered metal has a depth below 0.03 mm, the molten alloy does not easily infiltrate if the face is smooth. When said concave groove has a depth in excess of 1 mm, a large amount of brazing alloy is required, while its penetrating length into the interface to be bonded is shortened. The results of tests have made it clear that a depth resulting from 0.03 to 1 mm is most suitable.

As described hereinbefore, the invention makes it possible to produce economically sintered parts having complicated configurations which have heretofore been impossible to produce by the pressing process by use of conventional metal molds.

Furthermore, the sintered parts according to the invention can be applied to various uses which the conventional products could not cover, such as compressor parts, side plates for power steering, etc. This is because the tightness against high pressure liquids and gases has been improved as a result of full infiltration of the brazing alloy into the faces to be bonded together.

A concave groove of predetermined dimensions can be formed by a preliminarily prepared metal mold, while through holes for receiving the brazing alloy can also be formed by a metal mold. Thus, the invention makes it possible to produce sintered parts having complicated configurations in large amounts at a low cost.

I claim:

1. A method for producing a sintered structure of a complicated structure having more than two pieces of iron group sintered metals bonded at the flat faces thereof which comprises:

forming through holes at predetermined locations of the metal pieces, except for the metal piece constituting the lowermost layer;

providing a concave groove on at least one metal face of each of the metal faces to be bonded to each other;

superposing the metal pieces with said through holes so that the through holes of the metal pieces coincide with each other, said metal piece constituting the uppermost layer having more through holes than the metal piece underneath, and the succeeding metal pieces being arranged such that when a brazing alloy is placed into the topmost through holes, and melted, it can infiltrate into the interfaces between each of the metal layers;

placing a brazing alloy into each of the topmost through holes and heating the entire assembly so that the brazing alloy infiltrates into each of the metal layers to form the bonded structure.

2. A method according to claim 1 wherein the concave groove has a depth of 0.03 to 1.0 mm.

3. A method according to claim 1 wherein each of the metal pieces is a pressed compact.

4. A method according to claim 1 wherein each of the metal pieces is a pressed and sintered compact.

* * * * *